US007166792B2

(12) United States Patent
Hiratsuka et al.

(10) Patent No.: US 7,166,792 B2
(45) Date of Patent: Jan. 23, 2007

(54) STORAGE MEDIUM CONTAINING MUSICAL SCORE DISPLAYING DATA, MUSICAL SCORE DISPLAY APPARATUS AND MUSICAL SCORE DISPLAYING PROGRAM

(75) Inventors: Satoshi Hiratsuka, Hamamatsu (JP); Shuichi Matsumoto, Hamamatsu (JP)

(73) Assignee: Yamaha Corporation (JP)

( * ) Notice: Subject to any disclaimer, the term of this patent is extended or adjusted under 35 U.S.C. 154(b) by 328 days.

(21) Appl. No.: 10/669,782

(22) Filed: Sep. 24, 2003

(65) Prior Publication Data

US 2004/0069115 A1 Apr. 15, 2004

(30) Foreign Application Priority Data

Sep. 26, 2002 (JP) ..... 2002-281286
Sep. 26, 2002 (JP) ..... 2002-281287

(51) Int. Cl.
*G10H 7/00* (2006.01)
*G04B 13/00* (2006.01)
*A63H 5/00* (2006.01)

(52) U.S. Cl. ..... 84/609; 84/462; 84/477 R; 84/478; 84/634

(58) Field of Classification Search ..... 84/609, 84/477 R, 634, 462, 478
See application file for complete search history.

(56) References Cited

U.S. PATENT DOCUMENTS 4,510,840 A * 4/1985 Inami et al. ..... 84/477 R
5,665,927 A * 9/1997 Taki et al. ..... 84/609
5,773,741 A 6/1998 Eller et al.
6,235,979 B1 * 5/2001 Yanase ..... 84/477 R
6,313,387 B1 * 11/2001 Yamauchi ..... 84/609
6,380,471 B2 * 4/2002 Matsumoto ..... 84/477 R
2001/0023633 A1 * 9/2001 Matsumoto ..... 84/478
2001/0054347 A1 * 12/2001 Uehara ..... 84/477 R
2002/0134216 A1 * 9/2002 Shibukawa ..... 84/477 R
2003/0005814 A1 * 1/2003 Matsumoto ..... 84/477 R
2003/0167903 A1 * 9/2003 Funaki ..... 84/477 R
2003/0177887 A1 * 9/2003 Tanaka ..... 84/609
2004/0112201 A1 * 6/2004 Funaki ..... 84/477 R
2004/0182229 A1 * 9/2004 Jung et al. ..... 84/645

* cited by examiner

*Primary Examiner*—Lincoln Donovan
*Assistant Examiner*—Christina Russell
(74) *Attorney, Agent, or Firm*—Rossi, Kimms & McDowell, LLP

(57) ABSTRACT

Musical score displaying data include note or musical score information indicative of a note or musical score symbol to be displayed, position information indicative of a display position on a musical score where the note or musical score symbol is to be placed, and attribute information designating any one of a plurality of musical stave rows where the note or musical score symbol is to be displayed. Note or musical score marks of a same performance part can be displayed across two musical staves, by determining any one of the plurality of musical stave rows where the note or musical score symbol is to be displayed in accordance with the attribute information. In another aspect, the musical score displaying data include at least one of first attribute information for variably controlling the display position of the note or musical score symbol in a horizontal direction and second attribute information for variably controlling the display position of the note or musical score symbol in a vertical direction. With such first and second attribute information, the display position of the note or musical score symbol can be changed to an easier-to-view position.

17 Claims, 5 Drawing Sheets

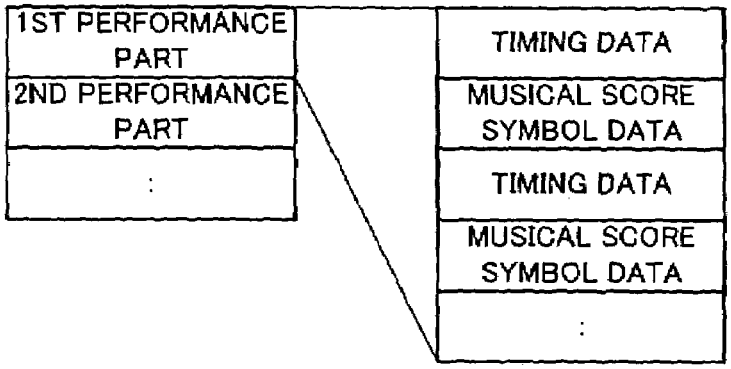

FIG. 2

(a)

| | | |
|---|---|---|
| vc | VOICE SECTION | 1− |
| tnn | NUMBER OF NOTES | 1−127 |
| dd | ORIENTATION OF NOTE STEM | 0(AUTO)、1(UPPER)、2(LOWER) |
| ff | NUMBER OF FLAGS | 0−7、−1(NONE) |
| bf | REARWARD BEAM | 0−7 |
| bb | FORWARD BEAM | 0−7 |

(b)

| | | |
|---|---|---|
| ty | TYPE OF NOTE | 0(TRIPLE WHOLE NOTE)−11(512TH NOTE) |
| nn | NOTE NO. | 0−127 |
| ac | ACCIDENTAL MARK | 1(NONE)、2(♭♭)、3(♭)、4(NATURAL)、5(♯)、6(♯♯) |

(c)

| | | |
|---|---|---|
| vc | VOICE SECTION | 1− |
| ty | TYPE OF NOTE | 0(TRIPLE WHOLE REST)−11(512TH REST) |
| dt | DOT | 0(NONE)、1(.)、2(..)、3(...) |

(d)

| | | | |
|---|---|---|---|
| ty | ATTRIBUTE TYPE | | 0(X OFFSET) |
| | | | 1(Y OFFSET) |
| | | | 2(STAFF NUMBER) |
| pppp | PARAMETER | 0 | −32768−32767:CLOCK |
| | | 1 | −32768−32767:IVORY |
| | | 2 | 0−31 |

FIG. 3

(a)

| | TIMING DATA | MUSICAL SCORE DATA |
|---|---|---|
| A | 1:1:000 | Stem : vc = 1, nn = 1, dd = 2(Lower), ff = 0, bf = 0, bb = 1 |
| B | 1:1:000 | Head : ty = 5(Eighth), nn = 74(D4), ac = 1(None) |
| C | 1:1:240 | Stem : vc = 1, nn = 1, dd = 2(Lower), ff = 0, bf = 1, bb = 1 |
| D | 1:1:240 | Head : ty = 5(Eighth), nn = 67 (G3), ac = 1(None) |
| E | 1:2:000 | Stem : vc = 1, nn = 1, dd = 1(Upper), ff = 0, bf = 1, bb = 1 |
| F | 1:2:000 | Attribute : ty = 2(StaveNumber), pppp = 1(Stave2) |
| G | 1:2:000 | Head : ty = 5(Eighth), nn = 48(C2), ac = 1(None) |
| H | 1:2:000 | Attribute : ty = 2(StaveNumber), pppp = 1(Stave2) |
| I | 1:2:240 | Stem : vc = 1, nn = 1, dd = 1(Upper), ff = 0, bf = 1, bb = 0 |
| J | 1:2:240 | Attribute : ty = 2(StaveNumber), pppp = 1(Stave2) |
| K | 1:2:240 | Head : ty = 5(Eighth), nn = 45(A1), ac = 1(None) |
| L | 1:2:240 | Attribute : ty = 2(StaveNumber), pppp = 1(Stave2) |

(b)

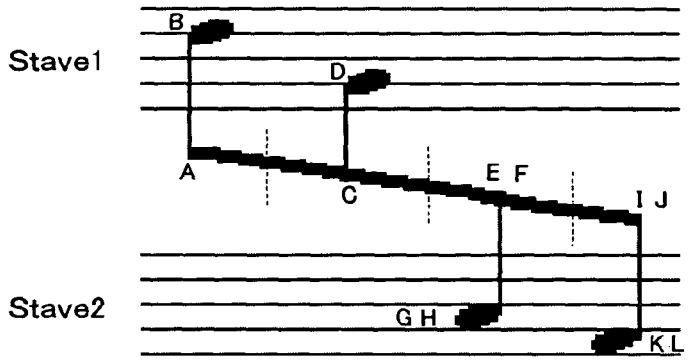

FIG. 5

(a)

| | TIMING DATA | MUSICAL SCORE DATA |
|---|---|---|
| A | 1:1:000 | Stem : vc = 1 |
| B | 1:1:000 | Head : ty = 4(Quarter), nn = 72(C4), ac = 1(None) |
| C | 1:1:000 | Rest : vc = 1, ty = 4(Quarter), dt = 0(None) |
| D | 1:1:000 | Attribute : ty = 1(Y Offset) pppp = -4 |

(b)

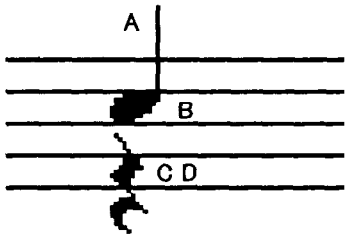

FIG. 6

| | TIMING DATA | MUSICAL SCORE DATA |
|---|---|---|
| A | 1:1:000 | STEM : VC = 1, NN = 1, DD = 1(UPPER), FF = 0, BF = 0, BB = 1 |
| B | 1:1:000 | HEAD : TY = 5(EIGHTH), NN = 64, AC = 1(NONE) |
| C | 1:1:000 | STEM : VC = 1, NN = 1, DD = 1(UPPER), FF = 0, BF = 1, BB = 0 |
| D | 1:1:240 | ATTRIBUTE : TY = 0(X OFFSET), PPPP = -60 |
| E | 1:1:240 | HEAD : TY = 5(EIGHTH), NN = 65, AC = 1(NONE) |
| F | 1:1:240 | ATTRIBUTE : TY = 0(X OFFSET), PPPP = -60 |

(b)

STORAGE MEDIUM CONTAINING MUSICAL SCORE DISPLAYING DATA, MUSICAL SCORE DISPLAY APPARATUS AND MUSICAL SCORE DISPLAYING PROGRAM

BACKGROUND OF THE INVENTION

The present invention relates to storage media containing musical score displaying data, musical score display apparatus for visually displaying a musical score using the musical score displaying data, and computer programs for displaying a musical score. More particularly, the present invention relates to a storage medium containing musical score displaying data that are arranged to display notes of a performance part across a plurality of musical staff or stave rows in accordance with attribute information that is included in the musical score displaying data for designating each stave to be displayed, and a musical score displaying apparatus and a musical score displaying program using the musical score displaying data to visually display a musical score. The present invention also relates to a storage medium containing musical score displaying data that are arranged to display musical score symbols and marks while appropriately controlling display positions of the symbols and marks in accordance with attribute information that is included in the musical score displaying data for designating horizontal or vertical display positions, and a musical score displaying apparatus and a musical score displaying program using the musical score displaying data to display a musical score.

There have been known apparatus and computer programs for displaying a musical score on the basis of automatic performance data (e.g., Japanese Patent Laid-open Publication No. HEI-11-327427). These musical score display apparatus and computer programs electronically display a musical score on a display device, such as one including a liquid crystal display (LCD) panel or cathode ray tube (CRT). In general, the automatic performance data are formatted to include data designating pitches of tones to be generated etc. along with timing data of tone generating and tone deadening events. Each of the timing data is information indicative of a time point when an event is to be generated, a time interval between successive events, or the like. In electronically displaying a musical score on a display screen on the basis of such automatic performance data, the automatic performance data are analyzed so that specific kinds of notes and rests are determined in accordance with tone generating time lengths (tone duration) and time intervals between successive tone generation timing. Further, various notes, rests, musical symbols and marks, etc. are displayed on a musical score by determining vertical display positions of the notes in accordance with tone pitches and horizontal display positions of the notes in accordance with note lengths.

Generally, in cases where a music piece comprising a plurality of performance parts is to be written on a musical score, there is employed a musical score made up of a plurality of stave rows. For example, a musical score for a piano is made up of two stave rows: one for a bass part (left-hand performance part) represented by the "F (bass) clef"; and one for a treble part (right-hand performance part) represented by the "G (treble) clef". Notes constituting the individual performance parts are written sequentially on these staves. In the conventionally-known apparatus, automatic performance data, not including or not associated with musical score displaying data indicative of particular display positions of individual musical score symbols, are analyzed on the basis of a preset tone pitch, and notes are each allocated to and displayed on any one of the treble and bass staves in accordance with the analyzed results. However, where notes of the left-hand performance part are to be displayed on the treble stave and notes of the right-hand performance part are to be displayed on the bass stave, the conventionally-known apparatus displays the notes on the respective staves, in a so-called marshaling fashion, merely on the basis of the automatic performance data analysis based on the preset pitch, i.e. without regard to on which of the treble and bass staves the notes should be actually displayed. Namely, the conventionally-known musical score displaying apparatus are not designed to display an inseparable group of notes of a performance part, which includes a note allocated to the treble stave and a note allocated to the bass stave, across the treble and bass staves; that is, the conventionally-known apparatus are designed to display such a inseparable group of notes on just one of the treble and bass staves. For the reason, it would be very difficult for a user to view the displayed musical score and accurately recognize connections between successive notes of the performance part. The inconveniences may be avoided by displaying the notes of the performance part across a plurality of stave rows on the basis of predetermined conditions; however, such an approach would be difficult to execute, because the musical score display tends to be uniform at every portion thereof if the conditions are fixed and thus the approach requires complicated conditions.

Further, the conventionally-known musical score displaying techniques would present the problem that they can not readily control display positions of musical score symbols and marks because they display a musical score on the basis of automatic performance data. Because the techniques are arranged to display the symbol of each note on the basis of note event data included in the automatic performance data, a display position of the note symbol is determined in accordance with a tone pitch and timing of the note, so that the note symbol is displayed at the determined display position. For other musical score symbols than note symbols, their display positions are preset uniformly in each of the apparatus; thus, the other musical score symbols are displayed at their respective preset display positions. Therefore, in cases where a great many note symbols and other musical score symbols are to be displayed in a small area on a display screen, a plurality of the musical score symbols would be displayed undesirably in an overlapping manner. However, with the conventionally-known musical score displaying techniques, where the display of musical score symbols is limited to the display positions determined by the automatic performance data and preset display positions and hence can not be controlled as desired, a musical score very difficult for the user to view would be displayed as it is. As one possible approach to avoid such an inconvenience, there may stored, in memory, display positions, in both horizontal and vertical directions, of musical score symbols so that the musical score symbols can be displayed freely at any appropriate positions. In such a case, however, the display positions of the musical score symbols to be stored in memory are absolute coordinates based on a given point on the display device, and therefore, for adaptation to display devices of various different sizes and shapes, they have to be rewritten in conformity with the individual display devices. Thus rewriting the display positions tends to be very cumbersome.

SUMMARY OF THE INVENTION

In view of the foregoing, it is an object of the present invention to provide a storage medium containing musical score displaying data capable of displaying a musical score in such a manner that notes of a same performance part are displayed across a plurality of stave rows in accordance with attribute information that is included in the musical score displaying data for designating each stave to be displayed, as well as a musical score display apparatus and a musical score displaying program using the musical score displaying data.

It is another object of the present invention to provide a storage medium containing musical score displaying data containing musical score displaying data capable of displaying a musical score readily viewable by a user, irrespective of a size and shape of a display device, by controlling the display device in accordance with attribute information that is included in the musical score displaying data for controlling display positions in horizontal and vertical directions.

According to a first aspect of the present invention, there is provided a machine-readable storage medium containing musical score displaying data, and the musical score displaying data comprise: data of note or musical score information indicative of a note or musical score symbol to be visually displayed; data of position information indicative of a display position on a musical staff where the note or musical score symbol is to be placed; and data of attribute information designating any one of a plurality of musical stave rows where the note or musical score symbol is to be displayed. With the present invention thus constructed, note or musical score symbols of a same performance part can be displayed across a plurality of musical stave rows, in accordance with designation by the attribute information, in an apparatus arranged to use the musical score displaying data by reading out the musical score displaying data from the storage medium.

According to a second aspect of the present invention, there is provided a musical score display apparatus for displaying a musical score on the basis of musical score displaying data, and the musical score displaying comprising: data of note or musical score information indicative of a note or musical score symbol to be visually displayed; data of position information indicative of a display position on a musical score where the note or musical score symbol is to be placed; and data of attribute information designating any one of a plurality of musical stave rows where the note or musical score symbol is to be displayed. The musical score display apparatus comprises: a display section; and a processing section coupled with the display section. The processing section is adapted to: determine a note or musical score symbol to be displayed on a musical score, in accordance with the note or musical score information; determine a display position on the musical score where the note or musical score symbol is to be placed, in accordance with the position information; and determine any one of a plurality of musical stave rows where the note or musical score symbol is to be displayed, in accordance with the attribute information. The display section displays the note or musical score symbol on a musical score in accordance with determination by the processing section, so that note or musical score symbols of a same performance part can be displayed across a plurality of musical stave rows in accordance with designation by the attribute information.

According to a third aspect of the present invention, there is provided a machine-readable storage medium containing musical score displaying data, and the musical score displaying data comprise: data of note or musical score information indicative of a note or musical score symbol to be visually displayed; data of timing information indicative of a horizontal display position on a musical score where the note or musical score symbol is to be placed; and data of attribute information designating a horizontal offset display position relative to the display position indicated by the timing information. Thus, a horizontal display position, on a musical score, of a note or musical score symbol can be varied, in accordance with designation by the attribute information, in an apparatus arranged to use the musical score displaying data by reading out the musical score displaying data from the storage medium.

According to a fourth aspect of the present invention, there is provided a machine-readable storage medium containing musical score displaying data, and the musical score displaying data comprise: data of note or musical score information indicative of a note or musical score symbol to be visually displayed; data of position information indicative of a display position on a musical score where the note or musical score symbol is to be placed; data of attribute information designating a vertical offset display position relative to a specific display position. Thus, a vertical display position, on a musical score, of a musical score symbol can be varied, in accordance with designation by the attribute information, in an apparatus arranged to use the musical score displaying data by reading out the musical score displaying data from the storage medium.

According to a fifth aspect of the present invention, there is provided a musical score display apparatus for displaying a musical score on the basis of musical score displaying data comprising: data of note or musical score information indicative of a note or musical score symbol to be visually displayed; data of timing information indicative of a horizontal display position on a musical score where the note or musical score symbol is to be placed; and data of attribute information for controlling a display position of the note or musical score symbol, the attribute information including at least one of first attribute information designating a horizontal offset display position relative to the display position indicated by the timing information and second attribute information designating a vertical offset display position relative to a specific display position. The musical score display apparatus comprises: a display section; and a processing section coupled with the display section. The processing section is adapted to: determine a note or musical score symbol to be displayed on a musical score, in accordance with the note or musical score information; determine a horizontal display position on the musical score where the note or musical score symbol is to be placed, in accordance with the timing information; and perform at least one of a process for, in accordance with the first attribute information, changing the horizontal display position of the note or musical score symbol from the determined display position and a process for, in accordance with the second attribute information, vertically varying the display position of the note or musical score symbol. Thus, the display section displays the note or musical score symbol on a musical stave in accordance with the process performed by the processing section.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIG. 2 is a conceptual diagram explanatory of an example of a format of musical score displaying data handled in the embodiment of FIG. 1;

FIG. 3 is a conceptual diagram explanatory of definition information for each type of event data;

FIG. 5 is a diagram showing a specific example where an inseparable train of notes is displayed across a plurality of stave rows;

FIG. 6 is a diagram showing a specific example of a display position having been adjusted in accordance with X- and Y-direction offset amounts indicated by attribute event data.

DETAILED DESCRIPTION OF EMBODIMENTS

Figure 1:
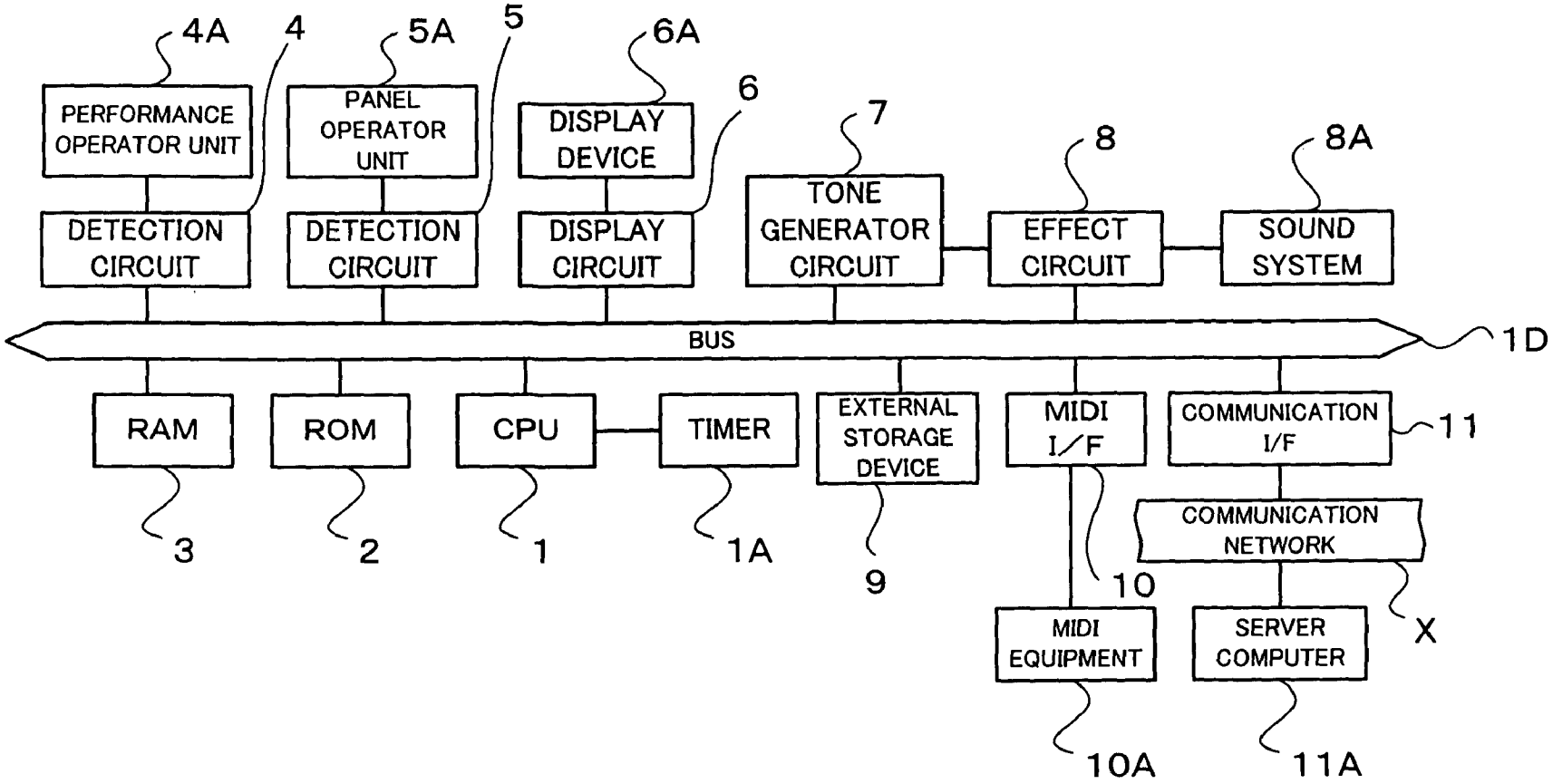
FIG. 1 is a block diagram illustrating a general hardware setup of an electronic musical instrument employing a musical score display apparatus in accordance with an embodiment of the present invention.

FIG. 1 is a block diagram illustrating a general hardware setup of an electronic musical instrument employing a musical score display apparatus in accordance with an embodiment of the present invention. This electronic musical instrument is controlled by a microcomputer comprising a microprocessor unit (CPU) 1, a read-only memory (ROM) 2 and a random-access memory (RAM) 3. The CPU 1 controls all operations of the electronic musical instrument. To the CPU 1 are connected, via a data and address bus 1D, the ROM 2, RAM 3, detection circuits 4 and 5, display circuit 6, tone generator (T.G.) circuit 7, effect circuit 8, external storage device 9, MIDI interface (I/F) 10 and communication interface 11. Also connected to the CPU 1 is a timer 1A for counting various time periods, for example, to signal interrupt timing for a timer interrupt process. Namely, the timer 1A generates tempo clock pulses, which are given to the CPU 1 as processing timing instructions or as interrupt instructions. The CPU 1 carries out various processes in accordance with such instructions.

The ROM 2 has prestored therein various programs, such as a musical score display processing program, to be executed by the CPU 1 and various data, such as musical score displaying data and automatic performance data, to be referred to by the CPU 1. The RAM 3 is used as a working memory for temporarily storing various data generated as the CPU 1 executes a predetermined program, as a memory for storing the currently-executed program and data related thereto, and for various other purposes. Predetermined address regions of the RAM 3 are allocated and used as registers, flags, tables, etc. Performance operator unit 4A is, for example, a keyboard including a plurality of keys for designating pitches of tones and key switches corresponding to the keys. The performance operator unit 4A, such as a keyboard, can be used not only as means for performing tones but also as input means for selecting a music piece of which a musical score is to be displayed. The detection circuit 4 detects depression and release of the keys on the operator unit 4A to thereby produce detection outputs. Panel operator unit 5A includes various switches and operators, such as switches for selecting a music piece of which a musical score is to be displayed and switches for inputting various information pertaining to an automatic performance etc. In addition to such switches, the panel operator unit 5A includes a ten-button keypad for entry of numeric value data, a keyboard for entry of character data, and various other operators, such as a mouse for operating a predetermined pointing element displayed on a display device 6A. The detection circuit 5 constantly detects respective operational states of the individual operators on the panel operator unit 5A and outputs switch information, corresponding to the detected operational states of the operators, to the CPU 1 via the data and address bus 1D. The display circuit 6 visually displays not only a musical score of a selected music piece, but also various information pertaining to an automatic performance, controlling state of the CPU 1, etc.

The tone generator (T.G.) circuit 7, which is capable of simultaneously generating tone signals in a plurality of channels, receives performance information supplied via the data and address bus 1D and generates tone signals based on the received performance information. Each of the tone signals thus generated by the tone generator circuit 7 is audibly reproduced or sounded by a sound system 8A after being imparted with en effect via an effect circuit 8. The effect circuit 8 includes a plurality of effect units which impart various effects to the tone signals, generated by the tone generator circuit 7, in accordance with effect parameters. The tone generator circuit 7, effect circuit 8 and sound system 8A may be constructed in any conventionally known manner. For example, any desired tone signal synthesis method may be used in the tone generator circuit 7, such as the FM, PCM, physical model or format synthesis method. Further, the tone generator circuit 7 may be implemented by either dedicated hardware or software processing performed by the CPU 1.

The external storage device 9 is provided for storing musical score displaying data, automatic performance data and data relating to control of various programs executed by the CPU 1. Where a particular control program is not prestored in the ROM 2, the control program may be prestored in the external storage device (e.g., hard disk device) 9, so that, by reading the control program from the external storage device 9 into the RAM 3, the CPU 1 is allowed to operate in exactly the same way as in the case where the particular control program is stored in the program memory 2. This arrangement greatly facilitates version upgrade of the control program, addition of a new control program, etc. The external storage device 9 may use any one of various removable-type media rather than the hard disk (HD), such as a flexible disk (FD), compact disk (CD-ROM or CD-RAM), magneto-optical disk (MO) and digital versatile disk (DVD). Alternatively, the external storage device 9 may use a semiconductor memory.

The MIDI interface (I/F) 10 is an interface provided for receiving or delivering performance information of the MIDI standard MIDI (i.e., MIDI data) from or to other MIDI equipment 10A or the like. Note that the other MIDI equipment 10A may be of any operating type, such as the keyboard type, stringed instrument type, wind instrument type, percussion instrument type or gesture type, as long as it can generate MIDI data in response to manipulations by a user. Note that the MIDI interface 10 may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface 10, the other MIDI equipment 10A may be designed to communicate other data than MIDI event data. Of course, the performance information handled in the present invention may be of any other data format than the MIDI format, in which case the MIDI interface 10 and other MIDI equipment 10A are constructed in conformity to the data format. The communication interface 11 is connected to a wired or wireless communication network X, such as a LAN (Local Area Network), the Internet or telephone line network, via which it may be connected to a desired sever computer 11A so as to input a control program and various data to the electronic musical instrument. Thus, in a situation where a particular control program and various data are not contained in the ROM 2 or external storage device (e.g., hard disk) 9, these control program and data can be downloaded from the server computer 11A via the communication interface 11. Such a communication interface may be constructed to be capable of both wired and wireless communication rather than either one of the wired and wireless communication. The musical score displaying data handled in the instant embodiment can be communicated with external equipment via the MIDI interface 10 or communication interface 11.

Further, in the above-described electronic musical instrument. the performance operator unit 4A may be of any other type than the keyboard instrument type, such as a stringed instrument type, wind instrument type or percussion instrument type. Furthermore, the electronic musical instrument is not limited to the type where the performance operator unit 4A, display device 6A, tone generator circuit 7, etc. are incorporated together as a unit within the musical instrument; for example, the electronic musical instrument may be constructed in such a manner that the above-mentioned sections are provided separately and interconnected via communication facilities such as a MIDI interface, various networks and/or the like. Moreover, the electronic musical instrument of the present invention may be applied to any desired apparatus and equipment, such as a portable communication terminal like a personal computer or portable phone, karaoke apparatus or game apparatus. In the case where the electronic musical instrument of the present invention is applied to a portable communication terminal, the predetermined functions may be performed as a whole in a system, comprising the terminal and a server, by causing the server to perform part of the functions, rather than causing the client terminal to perform all of the predetermined functions alone.

The following paragraphs describe the musical score displaying data stored in the ROM 2 or external storage device 9. FIG. 2 is a conceptual diagram explanatory of an example of a format of the musical score displaying data.

The musical score displaying data are data that define positions (display positions), on a plurality of musical stave rows electronically displayed on the display device 6A, where various events, such as notes and musical symbols, are placed or allotted and also define specific kinds of the events. The musical score displaying data are defined for each of a plurality of performance parts (e.g., left-hand and right-hand performance parts), and the musical score displaying data for each of the performance parts correspond to one of a plurality of stave rows. For example, the musical score displaying data for a first performance part are displayed on a first stave row on the display screen of the display device 6A, and the musical score displaying data for a second performance part are displayed on a second stave row on the display screen. The musical score displaying data for each of the performance parts include a plurality of event data each composed of timing data and musical symbol data. The timing data indicates a horizontal (X-direction) display position on the display device 6A where the corresponding musical score symbol data should be displayed; the timing data in the musical score displaying data is expressed in a similar format to timing data in automatic performance data. Typically, the timing data indicates a time relative to an event immediately preceding the event in question or an absolute time from the beginning of the music piece or measure, and it is represented by the number of clock pulses (or ticks) of a frequency corresponding to a quotient calculated by dividing the length of a predetermined note (e.g., quarter note) by a predetermined value, such as 960 or 480. In the instant embodiment, the timing data is represented by a combination of "measure number:beat number:clock pulse number" (e.g., "1:1:000" or "2:3:240"), as will be later described in FIG. 5 or 6. For example, the timing data "1:1:000" indicates an X-direction display position represented by a 0 (000)-th clock pulse at a first beat of a first measure, and the timing data "2:3:240" indicates an X-direction display position represented by a 240-th clock pulse at a third beat of a second measure. Namely, in the instant embodiment, the X-direction display positions of the musical score data displaying data are defined in a similar format to the timing data of the automatic performance data, and thus, in a case where both a set of automatic performance data and a set of musical score displaying data are stored or provided for a same music piece, it is possible to readily ascertain correspondency between notes in the two data sets because every pair of corresponding notes in the two data sets is imparted with timing data indicative of same timing.

Each of the musical symbol data includes event data representative of at least any one of a normal event, subevent and attribute event. In the instant embodiment, the data of the normal event is data to be used for displaying, on a musical score, a musical score symbol, such as a time signature, key signature, tempo mark, clef, note head, note stem, rest, measure line and text characters (alphabetical letters). The data of the subevent is data to be used for modifying a normal event immediately preceding the subevent; for example, the data of the subevent is for displaying, on a musical score, a symbol of a staccato, tenuto or the like pertaining to a note stem event, a dot following a note, or a symbol of a tie, glissando, portamento or the like. The data of the attribute event is data to be used for modifying a normal event or subevent immediately preceding the attribute event, and includes data indicative of a horizontal or vertical offset amount for the display position of the immediately-preceding normal event or subevent, data indicating whether the normal event or subevent should be displayed or not, data indicative of an identification number of a stave on which the normal event or subevent should be displayed, and parameters related thereto. The above-mentioned subevent and attribute event are each imparted with the same timing data as the normal event to be modified thereby, so that the event data to be modified can be clearly identified. A plurality of subevents and/or attribute events can be attached to each desired one of the normal events. Further, a plurality of attribute events can be attached to each desired one of the subevents. Needless to say, the kinds of musical score symbols are not limited to the above-mentioned.

For example, each of the above-mentioned event data is represented as a text meta event in a standard MIDI file (SMF), which includes: predetermined event information (e.g., sign "FF") indicating that the event is a meta event; "type" data indicative of a specific type of the event data; "data length" data indicative of a particular length of the event data variable in length; and a plurality of pieces of definition information necessary for display of a musical score corresponding to the "type".

Now, the definition information for each type of the event data is explained with reference to FIG. 3. Section (a) of FIG. 3 shows the definition information of a normal event for displaying a note stem, section (b) of FIG. 3 shows the definition information of a normal event for displaying a note head, section (c) of FIG. 3 shows the definition information of a normal event for displaying a rest, and section (d) of FIG. 3 shows the definition information of an attribute event. Here, the terms "note stem" are used to embrace a tail, a beam interconnecting short notes of one beat and a flag.

In the case of event data representing a normal event for displaying a note stem, "stem" is written as the "type" data, and the definition information, as illustrated in section (a) of FIG. 3, includes data indicative of a voice section (vc)(e.g., first or second voice section) corresponding to the performance part, a total number of notes (tnn) to be displayed simultaneously, an orientation (e.g., automatic, upward or downward) of the note stem, a total number of flags (ff), a total number of rearward (front-to-rear) beams for which display should be displayed from the beginning (bf), a total number of forward (rear-to-front) beams for which display should be displayed from the end (bb), etc. In the case of event data representing a normal event for displaying a note head, "head" is written as the "type" data, and the definition information, as illustrated in section (b) of FIG. 3, includes data indicative of a specific type of the note (ty)(e.g., one of tritone note to 512th note), a note number (nn) corresponding to a tone pitch, an accidental mark (ac)(e.g., sharp (#) or flat (♭)) to be imparted to the note, etc. Further, in the case of event data representing a normal event for displaying a rest, "rest" is written as the "type" data, and the definition information, as illustrated in section (c) of FIG. 3, includes data indicative of a voice section (vc), a specific type of the rest (ty)(e.g., one of tritone rest to 512th rest), a dot to be imparted to the rest (dt), etc.

Further event data representing an "attribute" type (ty), as illustrated in section (d) of FIG. 3, includes data indicative of a type of horizontal offset and a horizontal offset amount (0)(X offset) from a default display position represented by a timing value (e.g., number of clock pulses), a type of horizontal offset and type of vertical offset and a vertical offset amount (1)(Y offset) of a display position represented by pitch-related information (e.g., a specific number of white keys ("ivory")),. a staff identification, such as an identification number of a stave, (2)(stave number) where the attribute event is to be displayed. The event data illustrated in FIG. 3(*d*) gives examples of a predetermined parameter value (pppp) corresponding to the above attribute type. Specific examples of the definitions of these event data and a specific example of a musical score to be displayed on the basis of the event data will be described later in relation to FIGS. 5 and 6.

Needless to say, the types and definition information of the individual event data are not limited to the above-mentioned. Although not specifically shown in FIG. 3, in the case of event data representing a subevent for displaying, for example, a symbol of glissando, "glissando" is written as the type data, and the definition information includes data indicative of start• start/end• end of the glissando, type of display of the glissando (for example, data indicating that a wave line and glissando sign "gliss" are to be displayed simultaneously or that only the wave line is to be displayed), etc.

Figure 4:
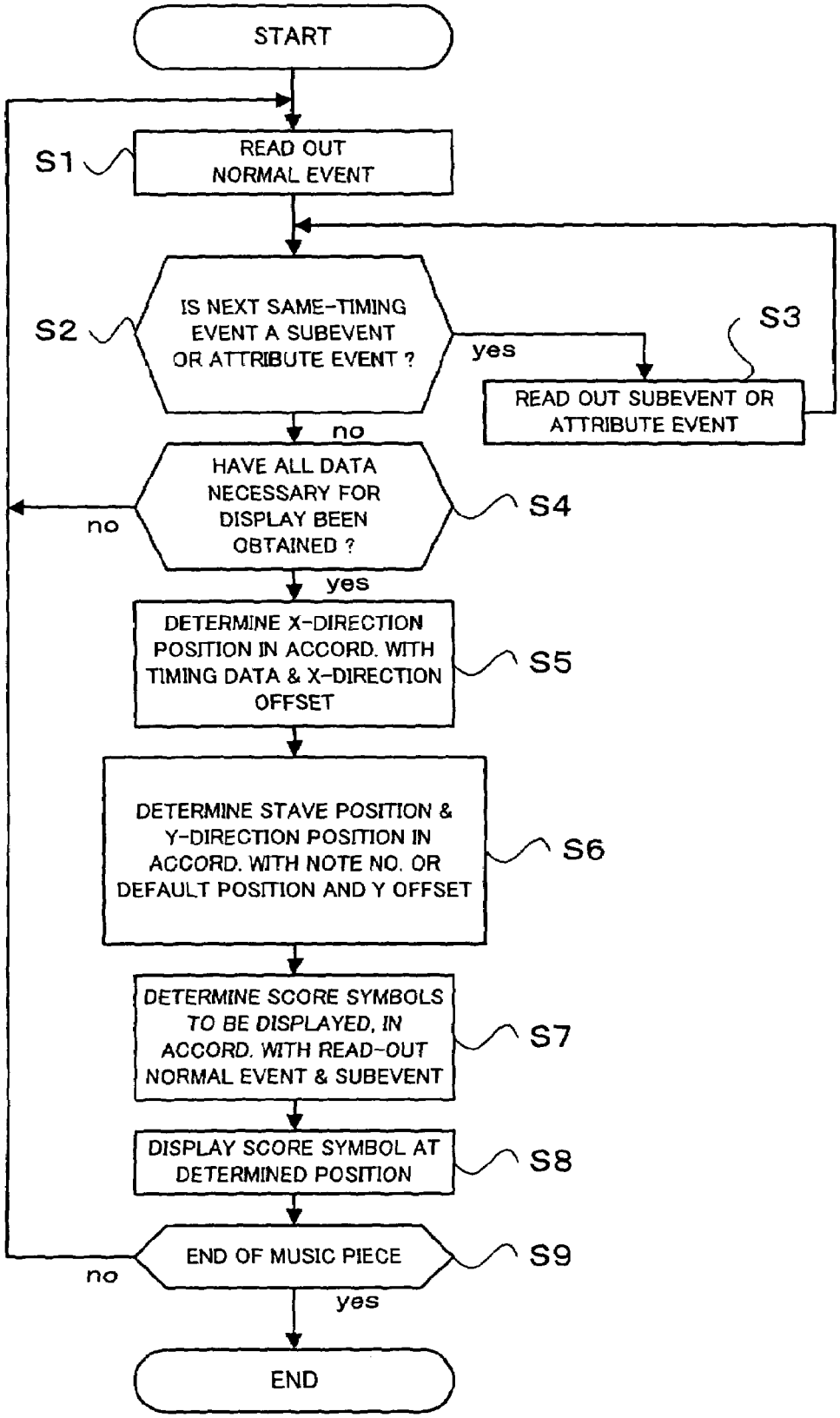
FIG. 4 is a flow chart showing an example of musical score display processing performed in the embodiment of FIG. 1.

In the electronic musical instrument of FIG. 1, a musical score is electronically displayed on the display device 6A in accordance with the above-described musical score displaying data. According to the most important feature of the present invention, an inseparable group or train of notes of a performance part can be displayed across a plurality of stave rows in accordance with the attribute information designating staves to be displayed. Further, any of musical score symbols, such as notes, rests and text characters, to be displayed on the musical score can be displayed at a position appropriately displaced from the default display position, in accordance with the attribute information designating an offset amount from the default display position. For such purposes, musical score display processing is performed by the CPU 1 of the electronic musical instrument of FIG. 1 executing a predetermined musical score display processing program (software). The musical score display processing will be described in detail, with reference to FIG. 4 that is a flow chart showing an example of the musical score display processing carried out on the basis of the part-by-part musical score displaying data.

At step S1, event data representative of a normal event, represented by type data "stem", "head", "rest" or the like, is read out from a set of musical score displaying data specified in accordance with selection of a music piece. At next step S2, a determination is made as to whether or not a next event having the same timing as the read-out normal event (namely, next same-timing event) is a subevent or attribute event. If the next same-timing event is subevent or attribute event (YES determination at step S2), the subevent or attribute event is read out at step S3. Namely, in the case where one or more subevents or attribute events are attached to a read-out normal event or where a plurality of attribute events are attached to a subevent, their event data are necessary information for determining musical score symbols and display positions of the musical score symbols, and therefore all of the subevents and attribute events attached to the normal event are read out. At step S4, a determination is made as to whether or not all the necessary data for display of a musical score have been obtained, i.e. whether or not all the event data necessary to determine musical score symbols and display positions of the musical score symbols have been read out. If all the necessary data for display of a musical score have not been obtained (NO determination at step S4), the CPU 1 reverts to step S1 to repeat the above-described operations. For example, whereas only one normal event has to be read out in order to display a musical score symbol of a whole note or rest, at least two or more normal events, such as those represented by type data "stem" and "head", have to be read out in order to display musical score symbols of a quarter note or eighth note, and therefore the operations of steps S1–S4 are repeated until all the necessary data have been read out.

If timing data and attribute event of an X-direction offset amount are attached to the normal event, an X-direction position (absolute coordinate) for displaying the musical score symbol is determined at step S5 in accordance with the X-direction offset amount. At next step S6, a stave position and Y-direction position (absolute coordinate) for displaying each musical score symbol are determined in accordance with a note number of the normal event for a note symbol or default position for another symbol, and, if attribute event of a Y-direction offset amount is attached, in accordance with the Y-direction offset amount and stave number. In the instant embodiment, a basic X-direction display position (default X-direction display position) is predetermined for each musical score symbol and for each timing of the score symbol. For example, in a case where a clef, key signature and leading note are allotted to timing value "0" (which is represented, for example, by timing data "1:1:000"), all of the musical score symbols are not displayed at the same X-direction position; instead, basic display positions are predetermined for the musical score symbols such that the symbols are displayed at respective appropriate positions. Similarly, a basic Y-position display position (default Y-direction display position) is predetermined for each musical score symbol. For each of the note symbols, however, the display position varies in the Y direction in accordance with a note number or key signature. In the instant embodiment, such X-direction and Y-direction display positions of musical score symbols are determined appropriately in accordance with a size and shape of the display screen employed. Thus, even musical score symbols set to the same timing will be displayed at different positions depending on the size and shape of the display screen. At step S7, musical score symbols to be displayed are determined in accordance with the read-out normal event and subevent. At next step S8, the thus-determined musical score symbols are displayed at the respective determined display positions. If an inseparable train of notes of a performance part to be displayed is split across a plurality of stave rows, a particular symbol pertaining to the note, such as a symbol of a beam interconnecting the plurality of notes, an arpeggio indicating that the plurality of notes are to be played successively in a broken-chord fashion or a glissando, is displayed across the plurality of stave rows. Details of operations to be performed when an inseparable train of notes of a performance part is split across a plurality of stave rows will be given later in relation to FIG. 5. At step S9, it is determined whether or not the end of the music piece has been reached, i.e. whether data indicative of the end of the music piece has been read out. If the end of the music piece has not been reached (NO determination at step S9), the CPU 1 reverts to step S1 in order to read out a next normal event, subevent, attribute event, etc. for next musical score display.

Because the identification numbers of staves where given notes are to be displayed are designated by attribute event data included in the musical score displaying data as set forth above, notes of a performance part can be displayed across a plurality of rows of staves. Further, because the attribute event data included in the musical score displaying data also designate offset amounts of display positions, musical score symbols to be displayed on a musical score can be displayed at positions appropriately displaced from the default display positions. Furthermore, the musical score displaying data include timing data in the instant embodiment, and thus, in the case where corresponding timing data of the automatic performance data and musical score indicate a same timing value, adjusting the display position in accordance with X- and Y-direction offset amounts indicated by the attribute event data as set forth above can effectively prevent musical score symbols from being undesirably displayed at inappropriate positions or in an overlapping manner to lead to a hard-to-view musical score display.

The following paragraphs describe a specific example of a musical score displayed on the basis of the musical score displaying data in the instant embodiment of the present invention.

Figure 7:
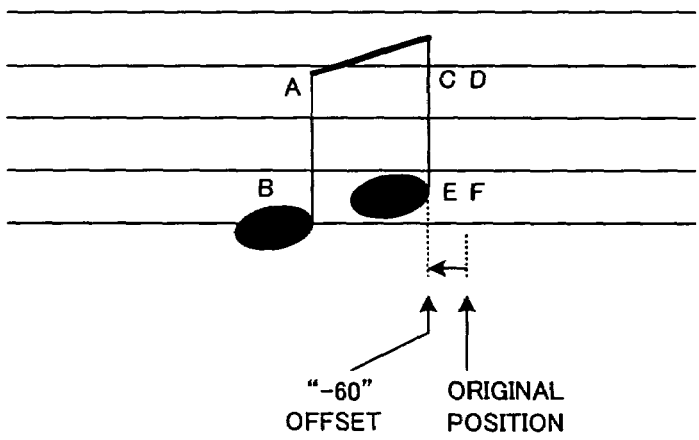
FIG. 7 is a diagram showing another example of a display position having been adjusted in accordance with X- and Y-direction offset amounts indicated by attribute event data.

FIG. 5 is a diagram showing a case where an inseparable train of notes is displayed across a plurality of stave rows. FIG. 6 is a diagram showing a display position having been adjusted in accordance with X- and Y-direction offset amounts indicated by attribute event data. FIG. 7 is a diagram showing another example of a display position having been adjusted in accordance with X- and Y-direction offset amounts indicated by attribute event data. In each of FIGS. 5 to 7, section (a) shows exemplary definitions of the musical score displaying data, and section (b) shows an example of a musical score displayed on the basis of the musical score displaying data. In FIGS. 5 to 7, reference characters "A", "B", "C", . . . are imparted to facilitate understanding of correspondency between the musical score displaying data and various events displayed on the basis of the displaying data. For example, reference character "A" represents a note stem event displayed on the basis of musical score displaying data A.

Referring to FIG. 5, event data A having timing data "1:1:000" is data for displaying a normal event represented by the type "stem", i.e. a note stem, which shows that the voice section is "first voice section" (i.e., treble section) (vc=1), the number of notes is "1" (tnn=1), the orientation of the note stem is downward (dd=2) and the number of flags is "0" (ff=0), the number of rearward (front-to-rear) beams is "0" (bf=0) and the number of forward (rear-to-front) beams is "1" (bb=1). Event data B, having the same timing data as the event data A, is data for displaying a normal event represented by the type "head", i.e. a note head, which shows that the type of the note is "eighth note" (ty=5 (eighth)), the tone pitch is "D4 " (nn=74 (D4)) and there is no accidental mark (ac=1 (none)). In accordance with the event data A, a note stem event A is displayed which includes a downward note tail, extending from a display position corresponding to X-direction position data "1:1:000" and Y-direction position data "D4", and a forward beam. In accordance with the event data B, a note head event B is displayed which represents an eighth note (with no accidental mark) at that display position corresponding to X-direction position data "1:1:000" and Y-direction position data "D4". Then, in accordance with event data C and event data D having timing data "1:1:240", a note stem event C is displayed which includes a downward note tail, extending from a display position corresponding to X-direction position data "1:1:240" and Y-direction position data "G3", and a rearward beam (bf=1) and forward beam (bb=1), as well as a note head event D which represents an eighth note (with no accidental mark) at that display position.

Then, in accordance with event data E and event data G having timing data "1:2:000", a note stem event E is displayed which includes an upward note tail, extending from a display position corresponding to X-direction position data "1:2:000" and Y-direction position data "C2", and a rearward beam (bf=1) and forward beam (bb=1), as well as a note head event F which represents an eighth note (with no accidental mark) at that display position. Attribute events F and H, both of type "attribute", are imparted to the event data E and event data G having timing data "1:2:000"; the attribute events F and H are each of type "2" (ty=2) and each have parameter "1" (pppp=1). Namely, the event data indicate that the stave to be displayed is a bass stave (stave 2: second stave row). Therefore, in this case, the musical score symbols to be displayed in accordance with the event data E and event data G (note stem event E and note head event F) are displayed on the bass stave, but as a continuation of the treble part. Namely, the musical score symbols of the event data E and event data G are displayed across the treble stave and bass stave in such a manner that the beam of the score symbols is connected with the beam of the preceding musical score symbols (note stem event C and note head event D). Similarly, attribute events J and L are imparted to event data I and event data K having timing data "1:2:240"; the attribute events J and L are each of type "2" (ty=2) and each have parameter "1" (pppp=1). Therefore, in this case too, the musical score symbols of the event data I and event data L (note stem event I and note head event L) are displayed across the treble stave and bass stave in such a manner that the beam of the score symbols is connected with the beam of the preceding musical score symbols (note stem event E and note head event F). With the musical score displaying data including such attribute information designating each stave to be displayed, and by displaying staves in accordance with the attribute information, it is possible to display notes of a performance part across a plurality of stave rows.

Now referring to FIG. 6, in accordance with event data A and event data B having timing data "1:1:000", a note stem event A is displayed which includes only an upward note tail extending from a display position corresponding to X-direction position data "1:1:000" and Y-direction position data "C4", and a note head event B representing a quarter note. In addition to the event data A and event data B, there is provided event data C, which represents a normal event of type "rest" and which shows that the voice section is "first voice section" (i.e., treble section) (vc=1), the type of the rest is "quarter rest" (ty=4 (quarter)) and there is no dot (dt=0). If the quarter rest event C is displayed at a display position corresponding to X-direction position data "1:1:000" and default Y-direction position data, then the displayed quarter rest event C would overlap already-displayed musical score symbols of a note stem event A and note head event B. Thus, event data D, representing an attribute event, is imparted to the rest event data C. The attribute event is of type "1" (ty=1) and has parameter "−4" (pppp=−4). As a consequence, the musical score symbol of the quarter rest event C to be displayed in accordance with the event data C is displayed at a display position (F3) offset, by an amount of four white keys, toward a lower pitch from the original or default Y-direction display position (C4). With the musical score displaying data including such attribute information that defines X-direction positions by the timing data and Y-direction positions by pitch-related information (e.g., information designating the number of white keys), and by displaying a musical score in accordance with the attribute information, it is possible to display notes at display positions appropriately displaced in the X or Y direction. Further, because the arrangement of section (b) of FIG. 6 allows a note symbol of a performance part to be displayed across a plurality of stave rows, it is possible that a same stave row will be used for display of notes or musical score symbols of two different performance parts.

Next referring to FIG. 7, in accordance with event data A and event data B having timing data "1:1:000", a note stem event A is displayed which includes an upward note tail with a forward beam (bb=1) extending from a display position corresponding to X-direction position data "1:1:000" and Y-direction position data "64" (E3), and a note head event B representing a eighth note. Then, in accordance with event data C, D, E and F having timing data "1:1:240", a note stem event C is displayed which includes a upward note tail, extending from a display position corresponding to X-direction position data "1:1:240" and Y-direction position data "65" (F3), and a rearward beam (bf=1), as well as a note head event E which represents an eighth note at that display position. Event data D, representing an attribute event, is imparted to the event data C. Event data F, also representing an attribute event, is also imparted to the event data E. Both attribute events D and F are of type "0" (ty=0) representing X-direction offset and have parameter "−60" (pppp=−60). As a consequence, the musical score symbol of the quarter note "F3" to be displayed in accordance with the event data C and E is displayed at a display position offset, by an amount of "−60", toward a forward direction from the original X-direction display position. Thus, with the musical score displaying data including such attribute information that defines the X-direction position by the timing data, and by displaying a musical score in accordance with the attribute information, it is possible to display notes at a display position appropriately displaced in the X direction.

Whereas the preferred embodiment of the present invention has been described above as imparting one or more subevents and attribute events to a single normal event, the single normal event may contain information of such subevents and attribute events. Further, whereas the preferred embodiment of the present invention has been described above as imparting one or more subevents and attribute events to a normal event to be modified by setting same time information to the subevents and attribute events, the subevents and attribute events may include information functioning like a pointer to the normal event to be modified.

Furthermore, the preferred embodiment of the present invention has been described above in relation to the case where each event representing a note is divided to a note stem event and note head event, there may be provided normal events having note stem and note head events collectively incorporated therein.

It should also be appreciated that the music score displaying data handled in the present invention may be in any desired format, such as: the "event plus relative time" format where the time of occurrence of each event is represented by a time length from the immediately preceding event; the "event plus absolute time" format where the time of occurrence of each event is represented by an absolute time within the music piece or a measure thereof; the "pitch (rest) plus note length" format where each data is represented by a pitch and length of a note or a rest and a length of the rest; or the "solid" format where a memory region is reserved for each minimum resolution of a performance and each event is stored in one of the memory regions that corresponds to the time of occurrence of the event.

Further, the time-serial music score displaying data may be stored in successive regions of a memory, or the time-serial music score displaying data may be stored in dispersed regions of the memory. In the latter case, the music score displaying data may be managed as time-serial successive data, and it does not matter whether or not the data are actually stored in succession in the memory. Moreover, the music score displaying data and automatic performance data may be stored together in a mixed manner.

In summary, the present invention is arranged to display an inseparable train of notes of a performance part across a plurality of stave rows in accordance with attribute information that is included in the musical score displaying data for designating each stave to be displayed. Thus, the present invention can advantageously display a musical score on which the user can easily see connections between successive notes of a performance part.

Further, the present invention is arranged to appropriately control display positions of musical score symbols in accordance with attribute information that is included in the musical score displaying data for appropriately designating horizontal- or vertical-direction display positions of the musical score symbols. Thus, the present invention can easily display a musical score readily viewable by the user, irrespective of a size and shape of a display device employed.

What is claimed is:

1. A machine-readable storage medium storing a computer-executable program containing instructions for:

reading musical score displaying data comprising:

data of note or musical score information indicative of a note or musical score symbol to be visually displayed;

data of position information indicative of a display position on a musical staff where the note or musical score symbol is to be placed; and data of attribute information designating any one of a plurality of musical stave rows where the note or musical score symbol is to be displayed; and displaying note or musical score symbols of a same performance part spanning across a plurality of musical stave rows, in accordance with designation by the attribute information, in an apparatus for displaying musical score.

2. A machine-readable storage medium as claimed in claim 1, wherein:

said musical score displaying data for a music piece include a group of event data representative of note or musical score symbols of the music piece, the data of the note information and the data of the position information are included in normal event data of a note or musical score symbol, and the data of the attribute information is imparted, as attribute event data, to the normal event data of a corresponding note or musical score symbol.

3. A machine-readable storage medium as claimed in claim 1, wherein:

said musical score displaying data for a music piece include a group of event data representative of a note or musical score symbol of the music piece, the data of the note information and the data of the position information are included in normal event data of note or musical score symbols, and the data of the attribute information is included in normal event data of a corresponding note or musical score symbol.

4. A musical score display apparatus for displaying a musical score on the basis of musical score displaying data, said musical score displaying data comprising:

data of note or musical score information indicative of a note or musical score symbol to be visually displayed;

data of position information indicative of a display position on a musical score where the note or musical score symbol is to be placed; and data of attribute information designating any one of a plurality of musical stave rows where the note or musical score symbol is to be displayed, wherein said musical score display apparatus comprises:

a display section; and a processing section coupled with said display section and adapted to:

determine a note or musical score symbol to be displayed on a musical score in accordance with the note or musical score information;

determine a display position on the musical score, where the note or musical score symbol is to be placed, in accordance with the position information; and determine any one of a plurality of musical stave rows, where the note or musical score symbol is to be displayed, in accordance with the attribute information, wherein said display section displays the note or musical score symbol on a musical score in accordance with said processing section, and displays note or musical score symbols of a same performance part spanning across a plurality of musical stave rows in accordance with designation by the attribute information.

5. A musical score display apparatus as claimed in claim 4, wherein when note or musical score symbols of a same performance part are to be displayed across a plurality of musical stave rows, in accordance with the designation by the attribute information and a given musical score symbol is to be displayed with the plurality of note marks to be displayed across the plurality of musical stave rows, the given musical score symbol is displayed across the plurality of musical stave rows along with the plurality of note marks.

6. A musical score display apparatus as claimed in claim 4, wherein said musical score displaying data are stored in a memory, and said processing section reads out the musical score displaying data from the memory and performs processing in accordance with the note or musical score information, the position information or the attribute information included in the read-out musical score displaying data.

7. A musical score display apparatus as claimed in claim 4, further comprising an interface section via which the musical score displaying data from outside said musical score display apparatus is received, and where said processing section performs on the basis of the musical score displaying data received via said interface section.

8. A computer-readable storage medium storing a computer-executable program containing a group of instructions for causing a computer to display musical score based on musical score displaying data, said musical score displaying data comprising:

data of note or musical score information indicative of a note or musical score symbol to be visually displayed;

data of position information indicative of a display position on a musical score where the note or musical score symbol is to be placed; and data of attribute information designating any one of a plurality of musical stave rows where the note or musical score symbol is to be displayed, wherein said group of instructions comprises:

determining a note or musical score symbol to be displayed on a musical score, in accordance with the note or musical score information;

determining a display position on the musical score, where the note or musical score symbol is to be placed, in accordance with the position information;

determining any one of a plurality of musical stave rows, where the note or musical score symbol is to be displayed, in accordance with the attribute information; and displaying note or musical score symbols of a same performance part spanning across different musical stave rows in accordance with designation by the attribute information.

9. A computer-readable storage medium as claimed in claim 8, wherein the note or musical score symbol is displayed on a musical stave visually shown on a display section.

10. A machine-readable storage medium storing a computer-executable program containing instructions for:

reading musical score displaying data comprising:

data of note or musical score information indicative of a note or musical score symbol to be visually displayed;

data of timing information indicative of a horizontal display position on a musical score where the note or musical score symbol is to be placed; and data of attribute information designating a horizontal offset display position relative to the display position indicated by the timing information, said data of attribute information including data identifying a type of horizontal offset and a parameter value representing an amount of the horizontal offset in a timing value; and varying a horizontal display position, on a musical score, of a note or musical score symbol, in accordance with designation by the attribute information, in an apparatus for displaying musical score.

11. A machine-readable storage medium storing a computer-executable program containing instructions for:

reading musical score displaying data comprising:

data of note or musical score information indicative of a note or musical score symbol to be visually displayed;

data of position information indicative of a display position on a musical score where the note or musical score symbol is to be placed; and data of attribute information designating a vertical offset display position relative to a specific display position, said data of attribute information including data identifying a type of vertical offset and a parameter value representing an amount of the vertical offset in pitch-related information; and varying a vertical display position, on a musical score, of a musical score symbol, in accordance with designation by the attribute information, in an apparatus for displaying musical score.

12. A machine-readable storage medium storing a computer-executable program containing instructions for:

reading musical score displaying data comprising:

data of note or musical score information indicative of a note or musical score symbol to be visually displayed;

data of timing information indicative of a horizontal display position on a musical score where the note or musical score symbol is to be placed;

data of first attribute information designating a horizontal offset display position relative to the display position indicated by the timing information, said data of first attribute information including data identifying a type of horizontal offset and a parameter value representing an amount of the horizontal offset in a timing value; and data of second attribute information designating a vertical offset display position relative to a specific display position, said data of second attribute information including data identifying a type of vertical offset and a parameter value representing an amount of the vertical offset in pitch-related information; and varying a horizontal display position, on a musical score, of a note or musical score symbol, in accordance with designation by said first attribute information, and varying a vertical display position, on a musical score, of a musical score symbol, in accordance with designation by said second attribute information, in an apparatus for displaying musical score.

13. A machine-readable storage medium as claimed in claim 12, wherein:

said musical score displaying data for a music piece include a group of event data representative of note or musical score symbols of the music piece, the data of the note information and the data of the timing information are included in normal event data of a note or musical score symbol, and the data of said first attribute information and said second attribute information are imparted, as attribute event data, to normal event data of a corresponding note or musical score symbol.

14. A machine-readable storage medium as claimed in claim 12, wherein:

said musical score displaying data for a music piece include a group of event data representative of note or musical score symbols of the music piece, the data of the note information and the data of the timing information are included in normal event data of a note or musical score symbol, and the data of said first attribute information and said second attribute information are included in normal event data of a corresponding note or musical score symbol.

15. A musical score display apparatus for displaying a musical score on the basis of musical score displaying data, said musical score displaying data comprising:

data of note or musical score information indicative of a note or musical score symbol to be visually displayed;

data of timing information indicative of a horizontal display position on a musical score where the note or musical score symbol is to be placed; and data of attribute information for controlling a display position of the note or musical score symbol, said attribute information including at least one of first attribute information designating a horizontal offset display position relative to the display position indicated by the timing information or second attribute information designating a vertical offset display position relative to a specific display position, said first attribute information including data identifying a type of horizontal offset and a parameter value representing an amount of the horizontal offset in a timing value, and said second attribute information including data identifying a type of vertical offset and a parameter value representing an amount of the vertical offset in pitch-related information, wherein said musical score display apparatus comprises:

a display section; and a processing section coupled with said display section and adapted to:

determine a note or musical score symbol to be displayed on a musical score, in accordance with the note or musical score information;

determine a horizontal display position on the musical score where the note or musical score symbol is to be placed, in accordance with the timing information; and perform at least one of changing the horizontal display position of the note or musical score symbol from the determined display position in accordance with said first attribute information or vertically varying the display position of the note or musical score symbol in accordance with said second attribute information, wherein said display section displays the note or musical score symbol on a musical stave in accordance with said processing section.

16. A computer-readable storage medium storing a computer-executable program containing a group of instructions for causing a computer to display musical score based on musical score displaying data, said musical score displaying data comprising:

data of note or musical score information indicative of a note or musical score symbol to be visually displayed;

data of timing information indicative of a horizontal display position on a musical score where the note or musical score symbol is to be placed; and data of attribute information for controlling a display position of the note or musical score symbol, said attribute information including at least one of first attribute information designating a horizontal offset display position relative to the display position indicated by the timing information or second attribute information designating a vertical offset display position relative to a specific display position, said first attribute information including data identifying a type of horizontal offset and a parameter value representing an amount of the horizontal offset in a timing value, and said second attribute information including data identifying a type of vertical offset and a parameter value representing an amount of the vertical offset in pitch-related information, wherein said group of instructions comprises:

determining a note or musical score symbol to be displayed on a musical score, in accordance with the note or musical score information;

determining a horizontal display position on the musical score where the note or musical score symbol is to be placed, in accordance with the timing information; and performing at least one of changing the horizontal display position of the note or musical score symbol from the determined display position in accordance with said first attribute information or vertically varying the display position of the note or musical score symbol in accordance with said second attribute information.

17. A computer-readable storage medium as claimed in claim 16, wherein said musical score display processing further comprises displaying the note or musical score symbol on a musical stave visually shown on a display section.

* * * * *